United States Patent [19]

Tsukasaki

[11] Patent Number: 4,666,142

[45] Date of Patent: May 19, 1987

[54] APPARATUS FOR FEEDING CARDBOARDS TO THE CARTON MAKING SECTION

[76] Inventor: Masatoshi Tsukasaki, 2-19, Higashikagaya 4-chome, Suminoeku, Osakashi, Japan

[21] Appl. No.: 521,560

[22] Filed: Aug. 9, 1983

[51] Int. Cl.[4] ..... B65H 3/24

[52] U.S. Cl. ..... 271/139; 271/42; 271/84; 271/269

[58] Field of Search ..... 271/131–144, 271/171, 223, 224, 238, 240, 269, 84

[56] References Cited

U.S. PATENT DOCUMENTS

| | | | |
|---|---|---|---|
| 763,943 | 6/1904 | Shuman | 271/139 |
| 2,844,371 | 7/1958 | Rowlands et al. | 271/135 |
| 2,954,976 | 10/1960 | Anderson et al. | 271/144 |
| 3,148,879 | 9/1964 | Kistner | 271/224 |
| 3,658,320 | 4/1972 | Kuehn | 271/144 |
| 3,804,402 | 4/1974 | Hottendorf | 271/144 |

*Primary Examiner*—Andres Kashnikow
*Assistant Examiner*—Matthew C. Graham
*Attorney, Agent, or Firm*—Birch, Stewart, Kolasch & Birch

[57] ABSTRACT

An apparatus of feeding cardboards to the carton making section, the apparatus including a kicker adapted to kick each cardboard on its rear end so as to enable same to be fed to the carton making section, the kicker being adjustable in its position in accordance with the widths of the cardboards in an easy, trouble-free way.

4 Claims, 7 Drawing Figures

APPARATUS FOR FEEDING CARDBOARDS TO THE CARTON MAKING SECTION

BACKGROUND OF THE INVENTION

The present invention relates to an apparatus of feeding cardboards to the carton making section, and more particularly, to an apparatus of feeding cardboards to the carton making section, wherein the apparatus includes a kicker adapted to kick each cardboard on its rear edge so as to enable same to be brought to the making section in its right posture.

In feeding cardboards to the carton making section, it is the common practice to employ a kicker for pushing each cardboard into the chute leading to the making section, wherein the cardboards are stored in a hopper or magazine. The conventional kicker is coupled to a crank whereby the kicker is reciprocally moved forward and backward, during the forward movement each cardboard is pushed toward the making section. Because of the crank mechanism the strokes of the kicker are predetermined. The strokes are previously calculated and determined in accordance with the size of the treating cardboards, and the time required for making one cardboard into one carton. Under the conventional mechanism, however, the adjustment is difficult and time-consuming when the stroke must be changed to meet varying factors, such as a change in the size of cardboard and/or the carton making speed. To carry out the adjustment, the operation must be suspended. This retards the production speed, and additionally, the procedure is complicated, and calls for experience and skill. These reflect in the production cost, and eventually on the prices of cartons.

OBJECTS AND SUMMARY OF THE INVENTION

The present invention is directed toward solving the problems pointed out above with respect to the conventional kicker, and has for its object to provide an apparatus of feeding cardboards wherein the kicker is readily adjusted in accordance with the varying widths of the cardboards.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided an apparatus of feeding cardboards to the carton making section, the apparatus including a rail provided along the cardboard feeding path, the rail including a first rack provided longitudinally thereof, means for moving the rail forward and backward along the cardboard feeding path, a kicker adapted to kick each cardboard on its tail portion toward the carton making section, the kicker including a second rack engageable with the first rack of the rail, means for effecting the engagement or disengagement between the first rack and the second rack, whereby the kicker is secured to the rail or made free therefrom, and a guide structure for supporting the cardboards with their tail ends in alignment, the guide structure being provided above the kicker and having means for allowing the cardboards to be supplied one by one to a point in front of the kicker.

DETAILED DESCRIPTION OF THE INVENTION

Figure 1:
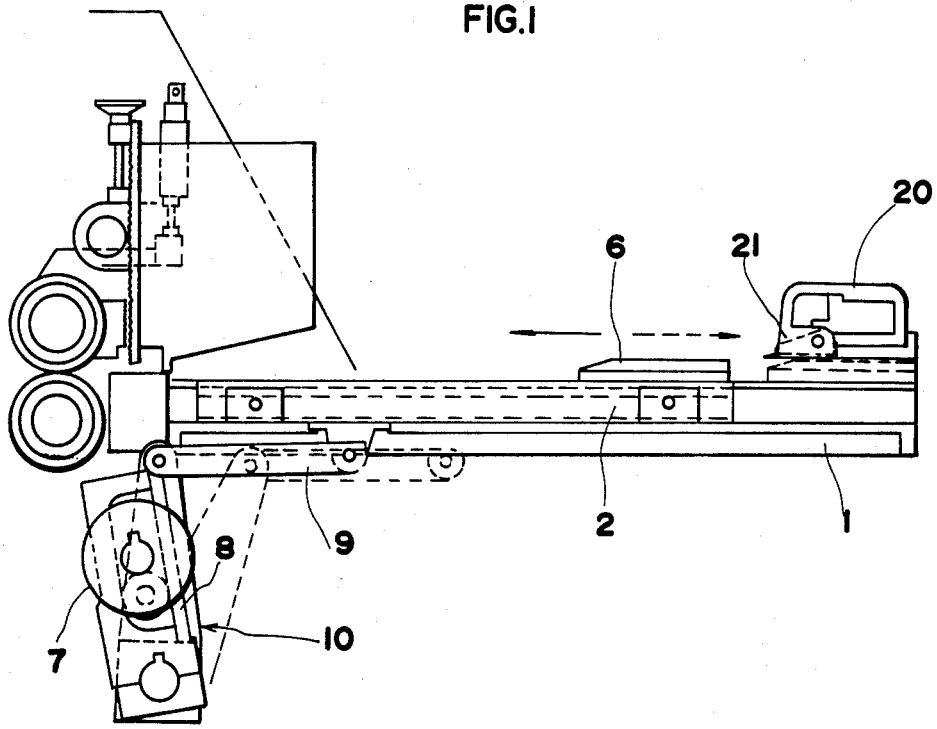
FIG. 1 is a side elevation of the carton processing machine including an apparatus of feeding cardboards embodying the present invention.
Figure 2:
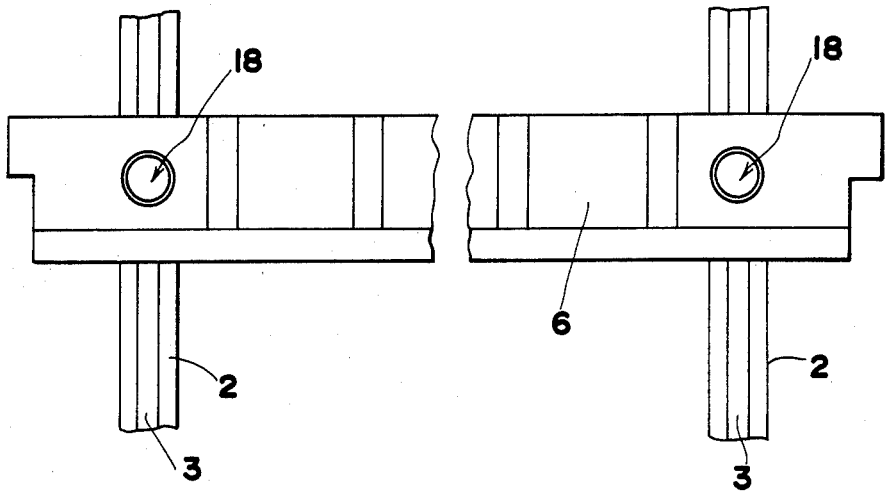
FIG. 2 is a plan view showing a kicker used in the apparatus shown in FIG. 1.

Referring to FIG. 1, there is provided a carton processing machine (not numbered) whereby each cardboard fed thereto is formed into a carton in an automatic way. The reference numeral 1 designates fixed rails on which kicker rails 2 are slidably mounted. The kicker rail 2 has a slit 3 in its top surface, and a chamber 4 inside, which extends along the length of the rail. In other words, the rail 2 is in a channel form. The rail 2 is provided with a rack 5 fixed to the upper side in which the slit 3 is produced. The reference numeral 6 designates a kicker whereby the cardboards are individually brought to the carton making section. The kicker 6 is coupled to a drive unit 10 which consists of a crank 7, a lever 8 and a link 9. The drive unit 10 is coupled to the rails 2, thereby enabling the kicker rail 2 to move reciprocally along the main rails 1 at predetermined strokes.

The kicker 6 includes a thin portion 11, which is intended to push against the tail end of the cardboard (A). The kicker 6 is mounted on the kicker rails 2 such that it can move forward and backward. The reference numeral 12 designates a short rack provided in the kicker 6, which rack 12 engages with the kicker rail 2. As shown in FIGS. 4 to 7, the kicker 6 is provided with a hole 13 in its top surface, and additionally, another hole 14 at the bottom of the hole 13, which second hole 14 is aligned with the slit 3 in the kicker rail 2. The first hole 13 is used to accommodate a lock member 18 of T-shape in cross-section, which includes a flange 16 and a threaded shaft 17. The lock unit 18 is vertically adjustable, wherein the reference numeral 15 (in FIG. 7) designates a spring. The threaded shaft 17 is coupled to the short rack 12 at its top end whereby when the lock member 18 is raised under the influence of the spring 15, the teeth 19 of the short rack 12 are engaged with the rack 5 on the kicker rail 2. Thus the kicker 6 is coupled to the kicker rail 2. Whereas, when the lock unit 18 is pushed downward against the spring 15, the teeth 19 are disengaged from the rack 5, thereby allowing the kicker to move forward or backward along the kicker rail 2. The rack 5 and the short rack 12 can have teeth of various forms; in the illustrated embodiment, they are rectangular in cross-section. It is preferred that the teeth have relatively small pitches. The lock unit 18 has a pusher provided by the flange 16 supported on the spring 15, wherein the pusher is preferably operated by an actuater or pusher provided in a guide structure 20 adjustable in accordance with the widths of the cardboards (A).

Figure 3:
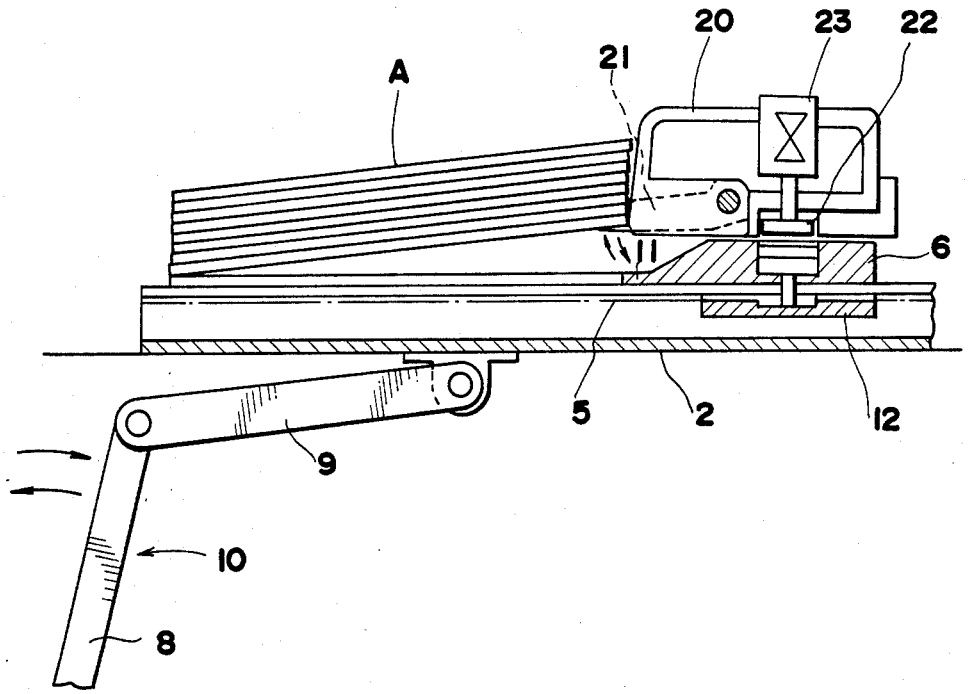
FIG. 3 is a side elevation showing the main portion of the apparatus shown in FIG. 1.
Figure 4:
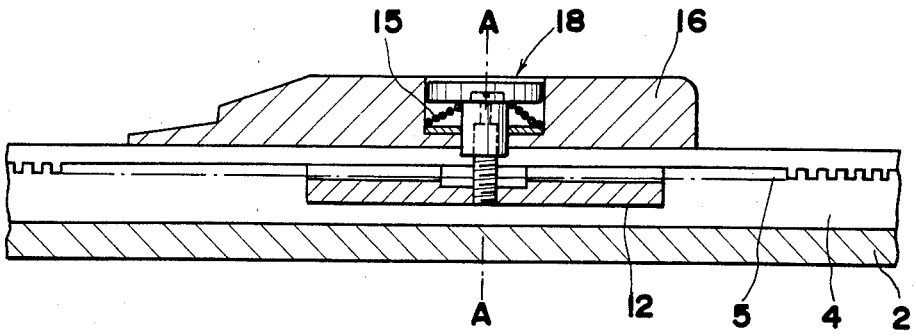
FIGS. 4 and 5 are views showing the states at which the kicker is engaged with and disengaged from the kicker rail, respectively.
Figure 5:
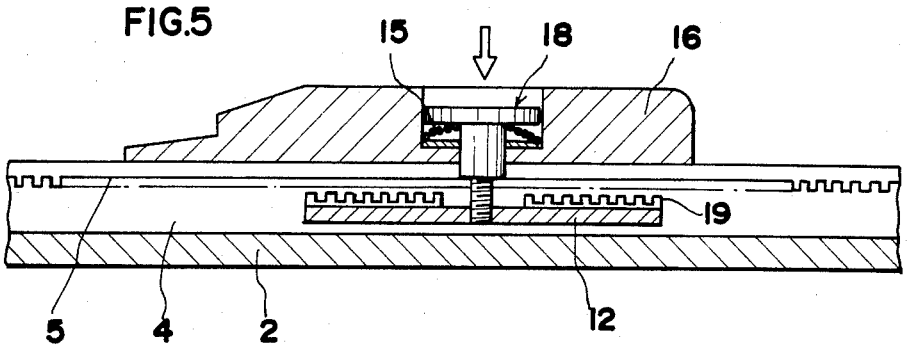
Figure 6:
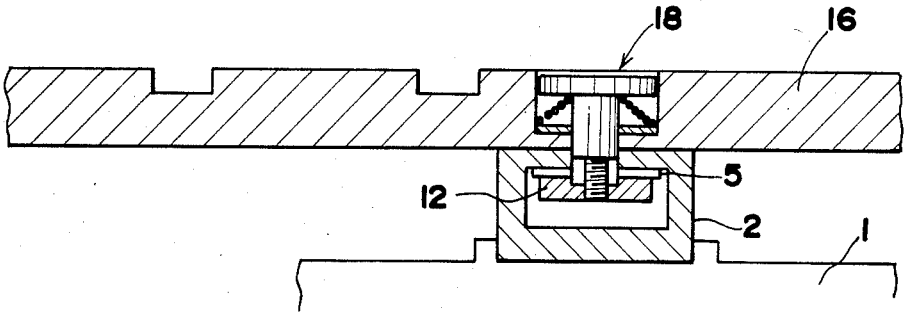
FIG. 6 is a cross-sectional view taken along the line A—A in FIG. 4.
Figure 7:
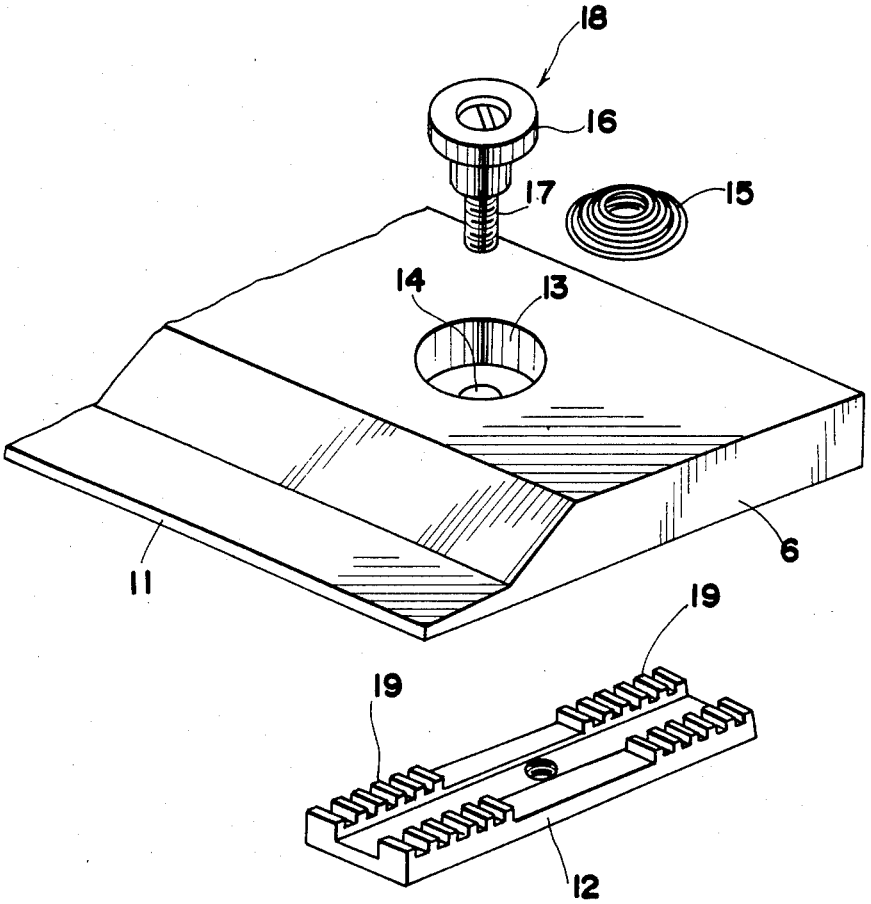
FIG. 7 is an analytical view showing the kicker and the rack member particularly to show a disassembled state thereof.

Referring to FIG. 3, the guide structure 20 will be more particularly described: This is used to support the cardboards (A) at their rear ends. The reference numeral 21 designates a swinging arm pivoted on the guide structure 20, which is designed to support the rear ends of the cardboards (A) in their raised posture as shown in FIG. 3. The swinging arm 21 is operated at each reciprocal movement of the kicker 6. The guide structure 20 is provided above the kicker 6 such that the kicker can move forward and backward thereunder. Normally the kicker 6 positions slightly backward of the top end of the guide structure 20, for example, 10 mm, from which position the kicker 6 starts its pushing operation. At this state the lock unit 18 of the kicker 6 is located in a face-to-face position with an actuater provided by a flange 22 coupled to a hydraulic cylinder 23. In this way the lock unit 18 is pushed downward, thereby enabling the short rack 12 to descend for disengagement from the rack 5. The kicker 6 is free to move forward or backward in accordance with the width of the cardboards (A). In this way the position of the kicker 6 and hence that of the guide structure 20 can be appropriately taken in accordance with the widths of the cardboards (A), wherein when the kicker and the guide structure are to be locked at the desired positions, the short rack 12 is placed into engagement with the rack 5 of the kicker rail 2, as shown in FIG. 4.

The procedure for positioning the kicker and the guide structure at a desired position will be described more in detail: At first, the drive unit 10 is driven so as to enable the kicker 6 to return to its original position. After it is confirmed that the kicker 6 is aligned with the guide structure 20, the hydraulic cylinder 23 is actuated to cause the lock unit 18 to descend so as to place the short rack 12 out of engagement from the rack 5 of the kicker rail 2. The kicker 6 and the guide structure 20 are ready to move and take positions in accordance with the width of the cardboards (A). This adjustment is carried out by hand. Eventually, the hydraulic cylinder 23 is deactuated so as to place the short rack 12 into engagement with the rack 5 of the kicker rail 2, thereby locking the kicker 6 at the position. From this position the kicker 6 starts its pushing operation.

In the embodiment described above the rack 5 is provided on the inner surface of the top side of the chamber 4 of the channel-like rail 2, and the short rack 12 on the kicker 6 is placed into engagement therewith or placed out of engagement therefrom during its vertical movement. However, the arrangement of the two racks is not limited to this embodiment. It is possible to modify in various ways; for example, the rack 5 can be produced on the side of the kicker rail 2, and the short rack 12 is located opposedly to the rack 5, thereby ensuring that the two racks are in a sideway relationship, whereas in the above-mentioned embodiment, they are in a vertical relationship. The actuater provided by the hydraulic cylinder 23 can be replaced by any other suitable means known in the art.

What is claimed is:

1. An apparatus for feeding cardboards comprising:

a rail provided along a cardboard feeding path, said rail including a first rack provided longitudinally thereof;

means for moving said rail forward and backward along the cardboard feeding path;

a kicker for moving each cardboard, said kicker including a second rack engageable with said first rack of said rail;

means for effecting engagement and disengagement between said first rack and said second rack, whereby said kicker is secured to said rail or made free therefrom;

a guide structure for supporting said cardboards with their tail ends in alignment, said guide structure being provided above said kicker and having means for allowing said cardboards to be fed one by one to a point in front of said kicker; and said means for effecting engagement and disengagement between said first and second racks comprises a first plunger unit attached to said second rack, a spring operatively positioned to bias said plunger so that said second rack engages said first rack and a second plunger unit hydraulically driven to engage said first plunger and thereby disengage said first rack and said second rack.

2. An apparatus as defined in claim 1, wherein said first plunger unit is located in a hole in said kicker.

3. An apparatus as defined in claim 1, wherein said first rack is located on the underside of said rail.

4. An apparatus as defined in claim 3, wherein said first plunger unit is located in a hole in said kicker.

* * * * *